US009834977B2

(12) United States Patent
Mori

(10) Patent No.: US 9,834,977 B2
(45) Date of Patent: Dec. 5, 2017

(54) STREETCAR DOOR SYSTEM

(71) Applicant: JAKES ASSOCIATES, INC., San Jose, CA (US)

(72) Inventor: John David Mori, Sunnyvale, CA (US)

(73) Assignee: JAKES ASSOCIATES, INC., San Jose, CA (US)

( * ) Notice: Subject to any disclaimer, the term of this patent is extended or adjusted under 35 U.S.C. 154(b) by 51 days.

(21) Appl. No.: 14/875,979

(22) Filed: Oct. 6, 2015

(65) Prior Publication Data

US 2016/0123065 A1 May 5, 2016

Related U.S. Application Data

(60) Provisional application No. 62/075,730, filed on Nov. 5, 2014.

(51) Int. Cl.
*E05F 15/605* (2015.01)
*E05F 15/42* (2015.01)
*E06B 3/48* (2006.01)

(52) U.S. Cl.
CPC ..... *E05F 15/605* (2015.01); *E05F 15/42* (2015.01); *E06B 3/481* (2013.01); *E05Y 2201/434* (2013.01); *E05Y 2800/70* (2013.01); *E05Y 2900/51* (2013.01)

(58) Field of Classification Search
CPC ..... E05F 15/51; E05F 15/603; E05F 15/70; E05F 15/63; E05F 15/605; E05F 15/42; E05F 17/004; E05D 15/264; E06B 3/481
USPC ..... 49/26–28
See application file for complete search history.

(56) References Cited

U.S. PATENT DOCUMENTS 1,736,390 A * 11/1929 Brubaker ..... E05F 15/605 160/188
2,249,273 A * 7/1941 Flogaus ..... B60J 5/0497 160/97
3,744,022 A * 7/1973 Olsen ..... G08B 3/10 180/286
4,133,365 A * 1/1979 Schleicher ..... H01H 3/24 160/118
4,301,621 A * 11/1981 Houweling ..... E05F 15/48 200/543
4,346,931 A * 8/1982 Merkle ..... B61D 19/02 160/118
4,432,406 A * 2/1984 Belanger ..... E05D 15/264 160/118
5,718,275 A * 2/1998 Williams ..... B60S 3/00 160/184

(Continued)

*Primary Examiner* — Justin Rephann
(74) *Attorney, Agent, or Firm* — Perkins Coie LLP

(57) ABSTRACT

A new door system and related technology for a passenger carrying rail vehicle, such as a President's Conference Committee (PCC) streetcar rail vehicle, and a method for retrofitting a rail vehicle door system with the new door system. In some embodiments, the new door system includes an electro-mechanical angle drive motor, a solid door control pivot rod, a door leaf panel clamp that is permanently connected to the solid door control pivot rod, a lever arm that includes a positive locking device and that is coupled to the solid door control pivot rod, and a connecting rod that is attached to the electro-mechanical angle drive motor and to the lever arm to enable the connecting rod to impart motion generated by the electro-mechanical angle drive motor to the lever arm.

2 Claims, 11 Drawing Sheets

(56) References Cited

U.S. PATENT DOCUMENTS

| | | | | |
|---|---|---|---|---|
| 6,470,952 | B1 * | 10/2002 | Cline | E05D 15/266<br>160/118 |
| 6,834,740 | B2 * | 12/2004 | Kurttila | E05F 15/47<br>180/286 |
| 2014/0299280 | A1 * | 10/2014 | Bowman | E05F 17/004<br>160/199 |

* cited by examiner

STREETCAR DOOR SYSTEM

CROSS-REFERENCE TO RELATED APPLICATIONS

This is a non-provisional application filed under 37 C.F.R. §1.53(b), claiming priority under U.S.C. Section 119(e) to U.S. Provisional Patent Application Ser. No. 62/075,730 filed Nov. 5, 2014, titled "STREETCAR DOOR SYSTEM," the entire disclosure of which is hereby expressly incorporated by reference in its entirety.

BACKGROUND

Some President's Conference Committee (PCC) streetcars include passenger entry/exit door systems that each include two bi-fold doors. Each bi-fold door is made of two panels. When the bi-fold doors of the door system are opened, the bi-fold doors accordion-fold to make way for passengers to enter and exit the streetcar.

BRIEF DESCRIPTION OF THE DRAWINGS

Embodiments of the present invention will be described and explained through the use of the accompanying drawings in which.

DETAILED DESCRIPTION

Figure 1A:
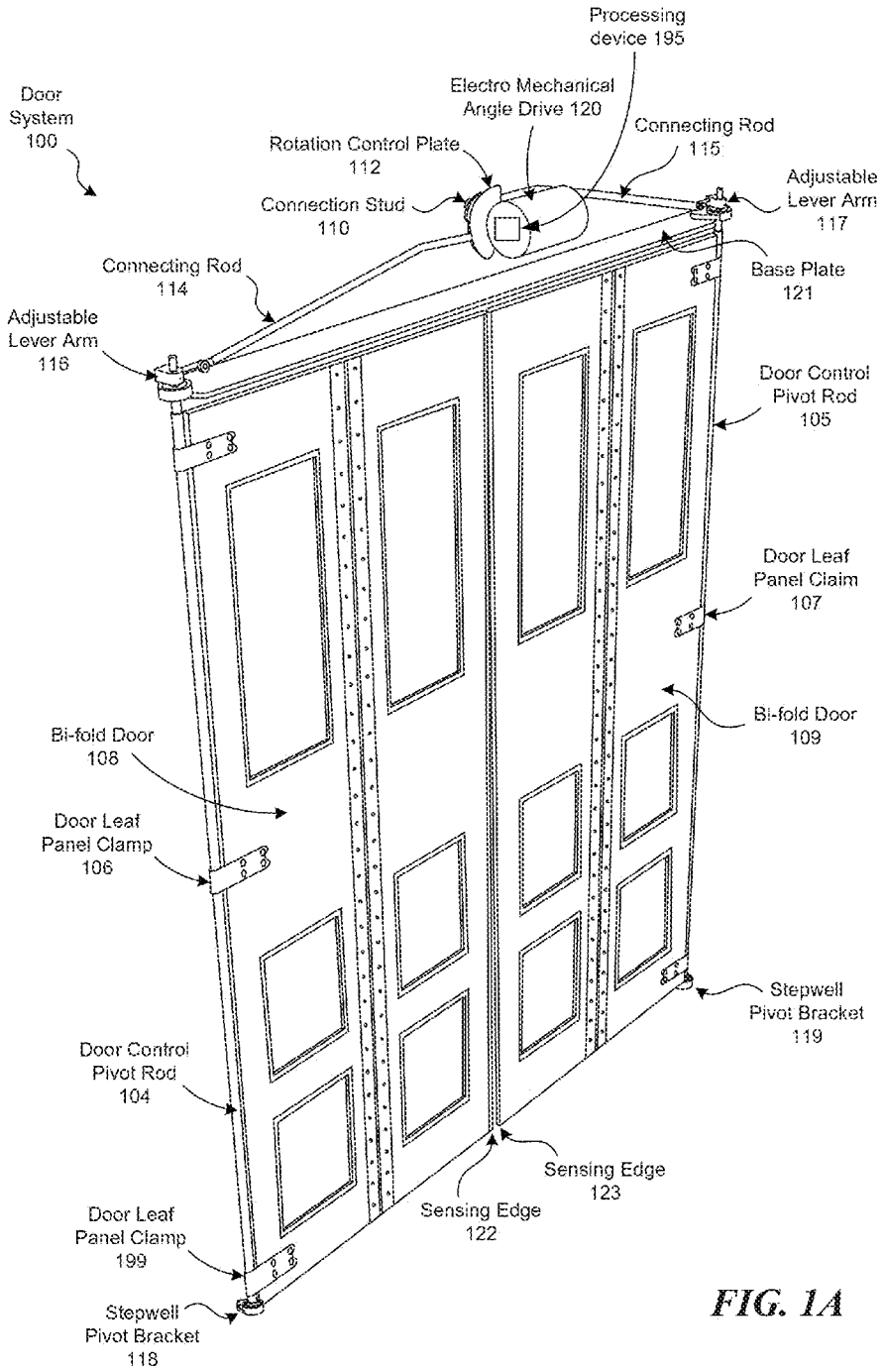
FIGS. 1A and 1B are illustrations of a door system that has been retrofitted in which a door is, respectively, closed and open, consistent with various embodiments.

This application discloses a new door system and related technology for a passenger carrying rail vehicle, such as a PCC streetcar, and a method for retrofitting a door system of the passenger carrying rail vehicle with the new door system. Doors of public transportation vehicles, such as PCC streetcars, may be operated very frequently. For example, public transportation vehicles may operate twenty-four hours a day seven days a week, and passenger entry/exit doors may be opened at each stop that a PCC streetcar makes to load and unload passengers. Further, public transportation vehicles may have very extended lifetimes. For example, PCC streetcars were manufactured in the United States from the 1930s to around 1952, and many are still in use today.

With such an extended use lifetime, long term reliability of components is critical to a safe and reliable operation of a fleet of PCC streetcars. Some PCC streetcar door systems fall short of the desired long term reliability. For example, some PCC streetcar door systems use linear induction motors, which produce motion in a straight line, to open and close bi-fold doors of the door system. Some such door systems have had reliability issues over the many decades of operation of PCC streetcars, leading to significant issues in maintaining a fleet of operational streetcars. Failure mechanisms have included, for example: motor failures, such as by failing to properly control the motor speed or the acceleration or deceleration of the motor resulting in doors that slam shut or slam open; failed or worn door components, such as those mechanical components that transfer the force of the linear induction motor to the doors to open or close the doors; broken or cracked glass windows of the doors; etc.

High quality, durable, and reliable door systems are what demanding transit operators have come to expect from experienced transit system suppliers. The liability and maintenance risks associated with a poorly designed and fabricated system can be substantial. The new door system is designed to provide decades of safe, reliable, and cost effective service for a PCC streetcar. The new door system can blend harmoniously into the historic nature of a PCC streetcar fleet while insuring door subsystem fleet standardization and a supply of spare and replacement parts from local sources.

In this description, references to "an embodiment", "one embodiment" or the like, mean that the particular feature, function, structure or characteristic being described is included in at least one embodiment of the technique introduced here. Occurrences of such phrases in this specification do not necessarily all refer to the same embodiment. On the other hand, the embodiments referred to also are not necessarily mutually exclusive.

Further, in this description the term "cause" and variations thereof refer to either direct causation or indirect causation. For example, a computer system can "cause" an action by sending a message to a second computer system that commands, requests, or prompts the second computer system to perform the action. Any number of intermediary devices may examine and/or relay the message during this process. In this regard, a device can "cause" an action even though it may not be known to the device whether the action will ultimately be executed.

Figure 1B:
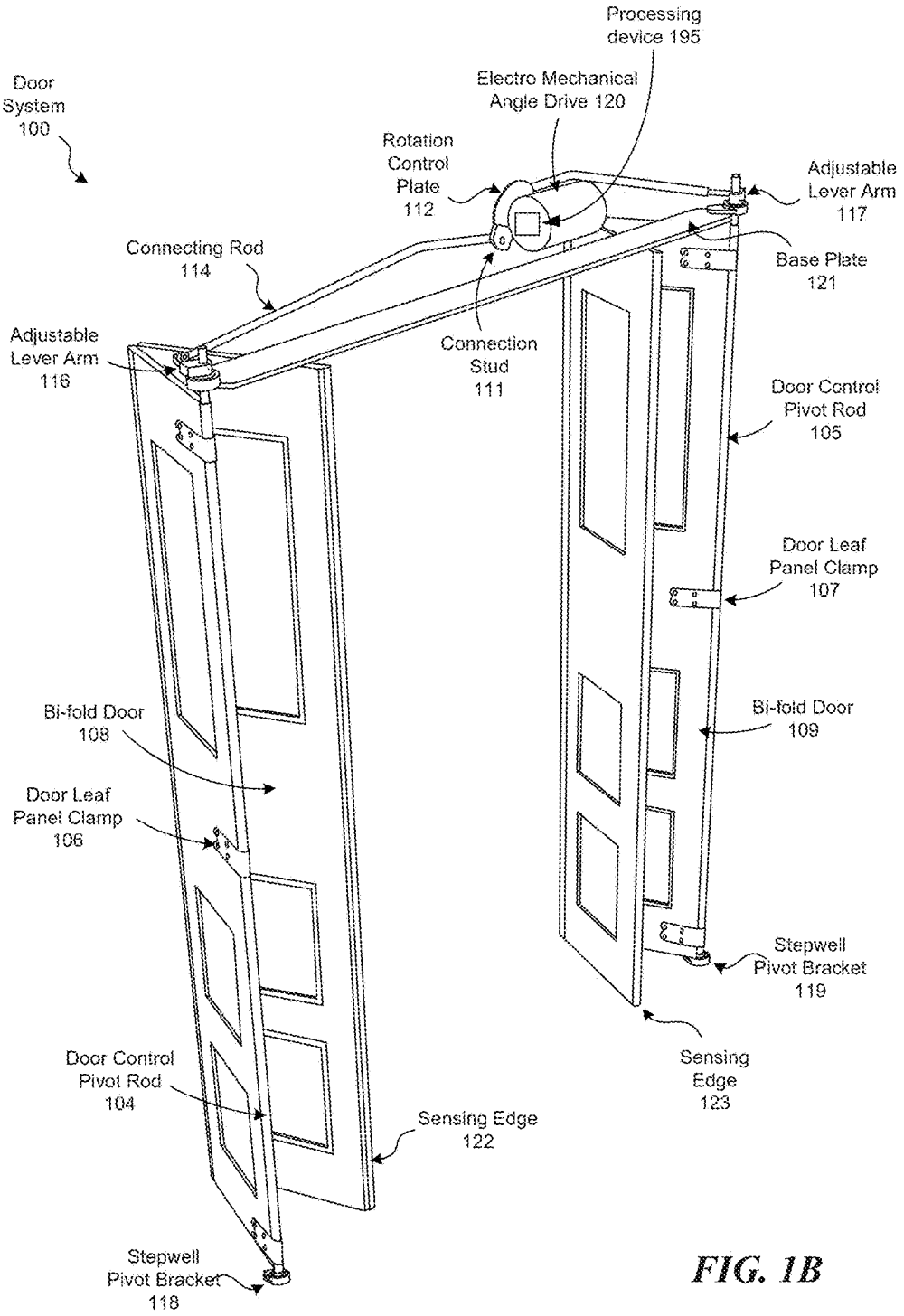

FIGS. 1A and 1B are illustrations of a door system that has been retrofitted in which a door is, respectively, closed and open, consistent with various embodiments. Door system 100 of the embodiment of FIGS. 1A and 1B is a door system that includes two bi-fold doors, where each bi-fold door includes two door panels. For example, one of the bi-fold doors of door system 100, bi-fold door 108, includes a first door panel, that is connected to door leaf panel clamp 106, and a second door panel, that is connected to sensing edge 122. A panel of bi-fold door 108 is attached to door control pivot rod 104 via three door leaf panel clamps, such as door leaf panel clamps 106 and 199. An illustration of door leaf panel clamp 199 appears in FIG. 5A.

Figure 5A:
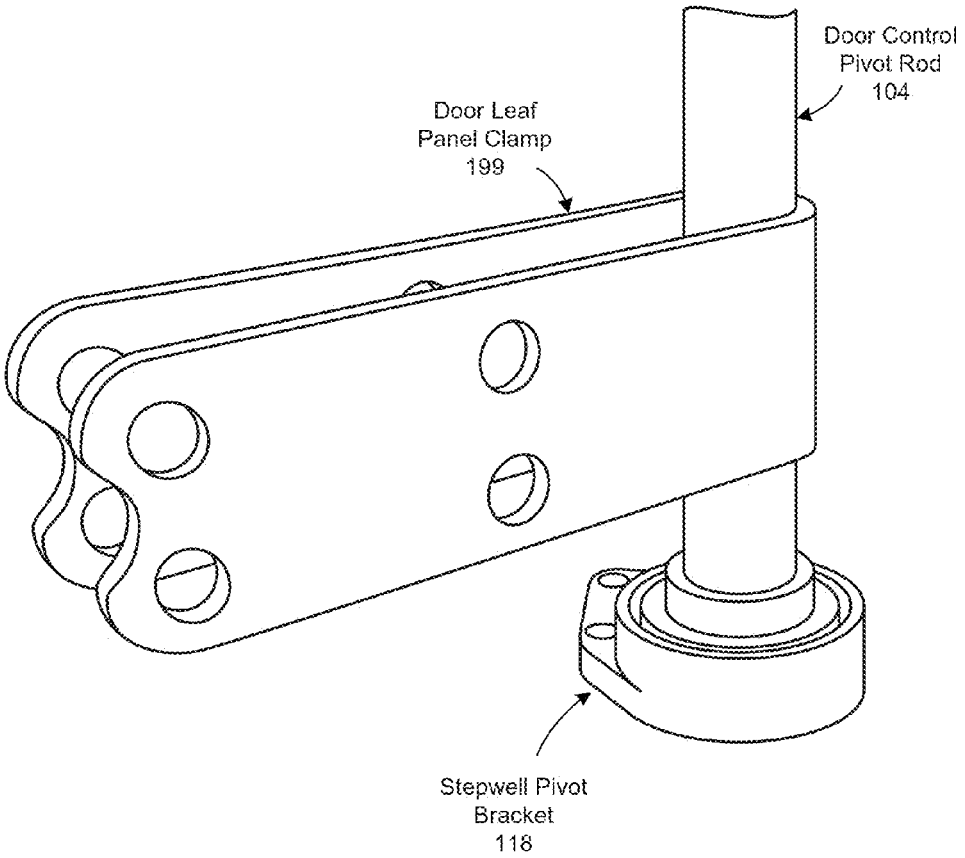
FIG. 5A is an illustration of a bottom portion of a door control pivot rod, consistent with various embodiments.

The three door leaf panel clamps are welded to door control pivot rod 104. FIG. 5A shows door leaf panel clamp 199 after being welded to door control pivot rod 104. Door leaf panel clamp 199 of FIG. 5A is located near a first end of door control pivot rod 104, the first end being the end that is attached to the stepwell of the street car and held in place by stepwell pivot bracket 118.

Figure 2:
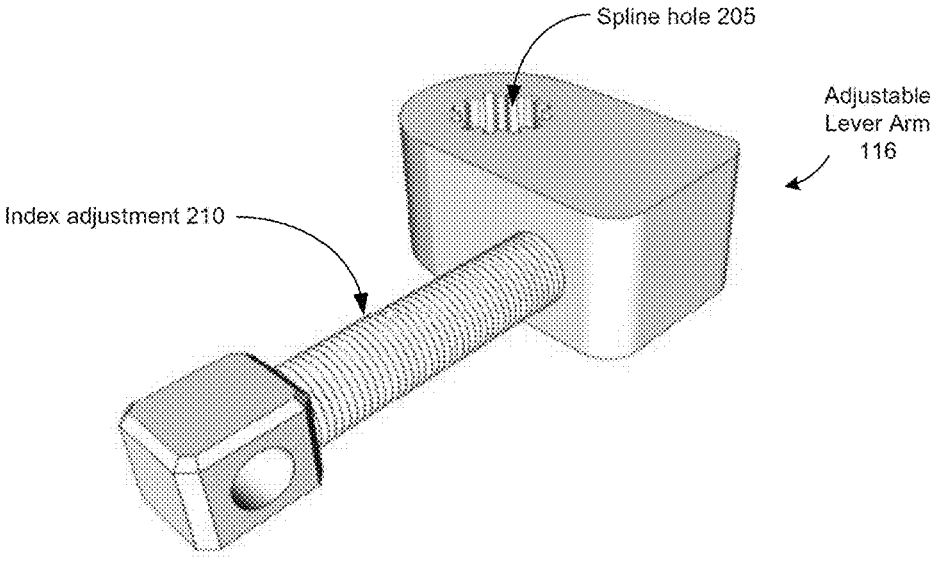
FIG. 2 is an illustration of an adjustable lever arm, consistent with various embodiments.
Figure 3:
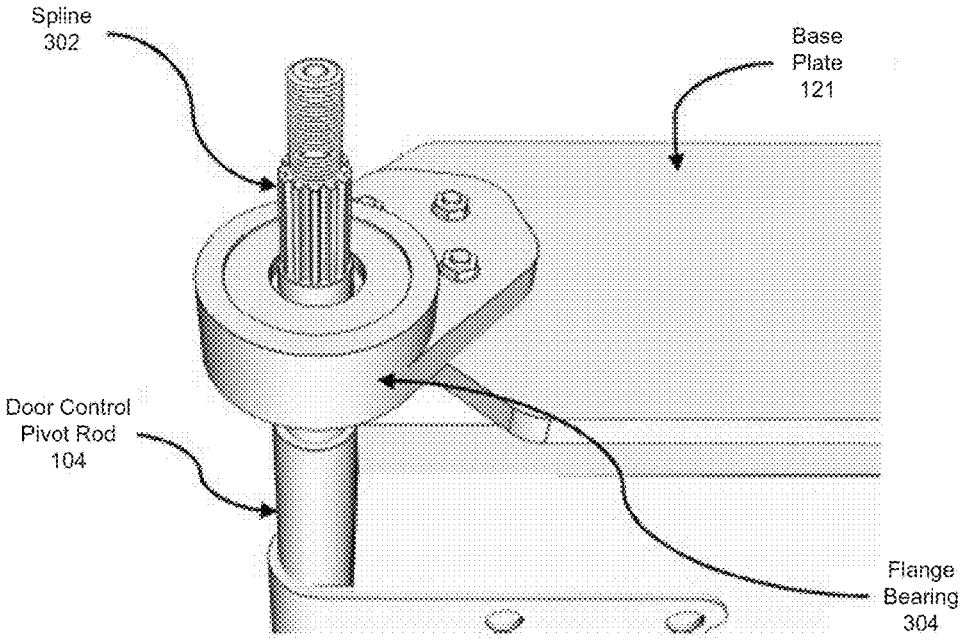
FIG. 3 is an illustration of a top portion of a door control pivot rod, consistent with various embodiments.

Door control pivot rod 104, at a second end, includes a positive locking device, spline 302, which is illustrated in FIG. 3. Adjustable lever arm 116 includes a corresponding locking device, spline hole 205, which is illustrated in FIG. 2. A positive locking device is a device, such as spline 302 or spline hole 205, which enables a first apparatus to be positively locked to a second apparatus, such that force can be applied by the first apparatus to the second apparatus without slippage between the two devices. For example, in FIG. 1A, spline 302 and spline hole 205 each enable adjustable lever arm 116 to be positively locked to door control pivot rod 104 such that a force applied to adjustable lever arm 116 can be applied as torque to door control pivot rod 104 without adjustable lever arm 116 slipping relative to the direction of rotation of door control pivot rod 104. Adjustable level arm 116 does not slip when applying the torque because spline 302 is inserted in spline hole 205, which creates a non-slip positive locking connection between adjustable lever arm 116 and door control pivot rod 104.

Adjustable lever arm 116, a drawing of which appears in FIG. 2, is mounted on spline 302 via spline hole 205. Adjustable lever arm 116 is adjustably connected to connecting rod 114, which is connected to connection stud 111 of rotation control plate 112. Connecting rod 114 can also be adjustably connected to connection stud 111. Connecting rod 114 can be formed of high grade steel. In some embodiments, a polytetrafluoroethylene (PTFE) lined sleeve bearing is mounted to each end of connecting rod 114.

Figure 4:
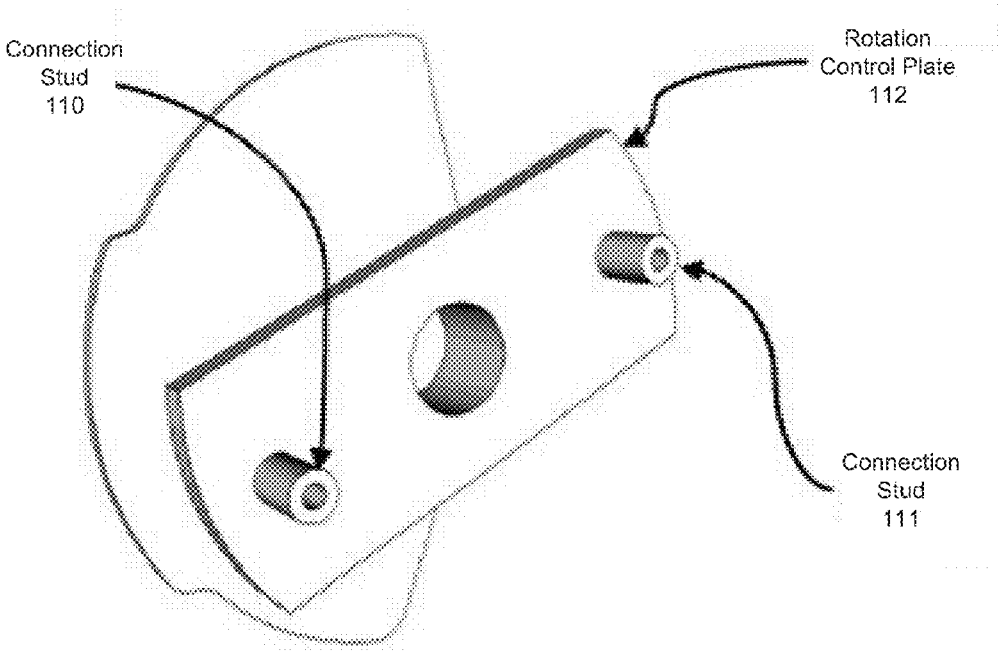
FIG. 4 is an illustration of a rotation control plate of an electro-mechanical angle drive, consistent with various embodiments.
Figure 8:
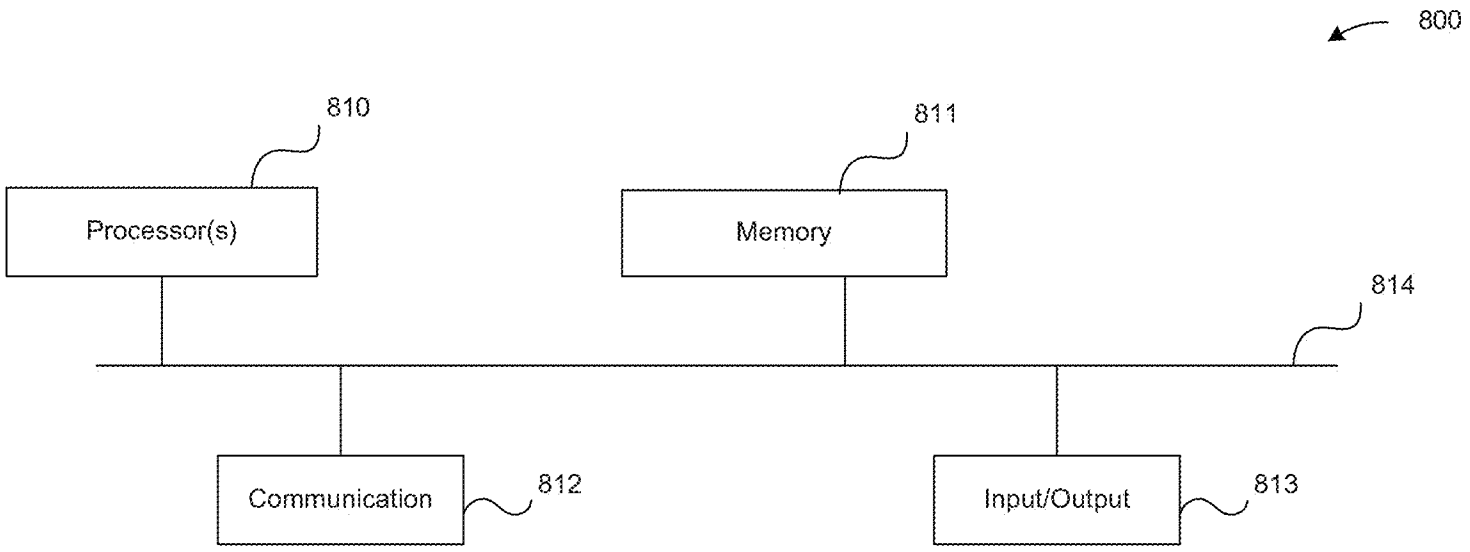
FIG. 8 is a high-level block diagram showing an example of processing system, consistent with various embodiments.

Rotation control plate 112 is connected to electro-mechanical angle drive 120, which provides mechanical power to rotation control plate 112 that causes rotation control plate 112 to rotate. Electro-mechanical angle drive 120 can be a motor that is powered by a direct current (DC) power supply. In some embodiments, electro-mechanical angle drive 120 is powered by a 36 volt DC power source. FIG. 4 is an illustration of rotation control plate 112, which includes connection studs 110 and 111. Processing device 195, which can be processing device 800 of FIG. 8, is coupled with electro-mechanical angle drive 120, and can control electro-mechanical angle drive 120.

Two sensing edges are attached to the two center door panels. Sensing edge 122 is attached to a panel of bi-fold door 108, and sensing edge 123 is attached to a panel of bi-fold door 109. Sensing edges 122 and 123 abut when the bi-fold doors are closed, as is shown in FIG. 1A. Sensing edges 122 and 123 sense when they touch an object, such as a person. The sensing edges relay this information to door system 100, which can stop the closing of the bi-fold doors when a sensing edge is detected to touch an object. In some embodiments, a sensing edge, such as sensing edge 122, includes a hollow cavity that runs the length of the sensing edge. When sensing edge 122 touches an object, the hollow cavity is compressed, which increases the air pressure in the cavity. This increase in air pressure can be detected, and a signal can be sent to electro-mechanical angle drive 120 that can cause electro-mechanical angle drive 120 to stop or reverse direction, which causes the door to stop closing, or to reverse and start opening.

Figure 6A:
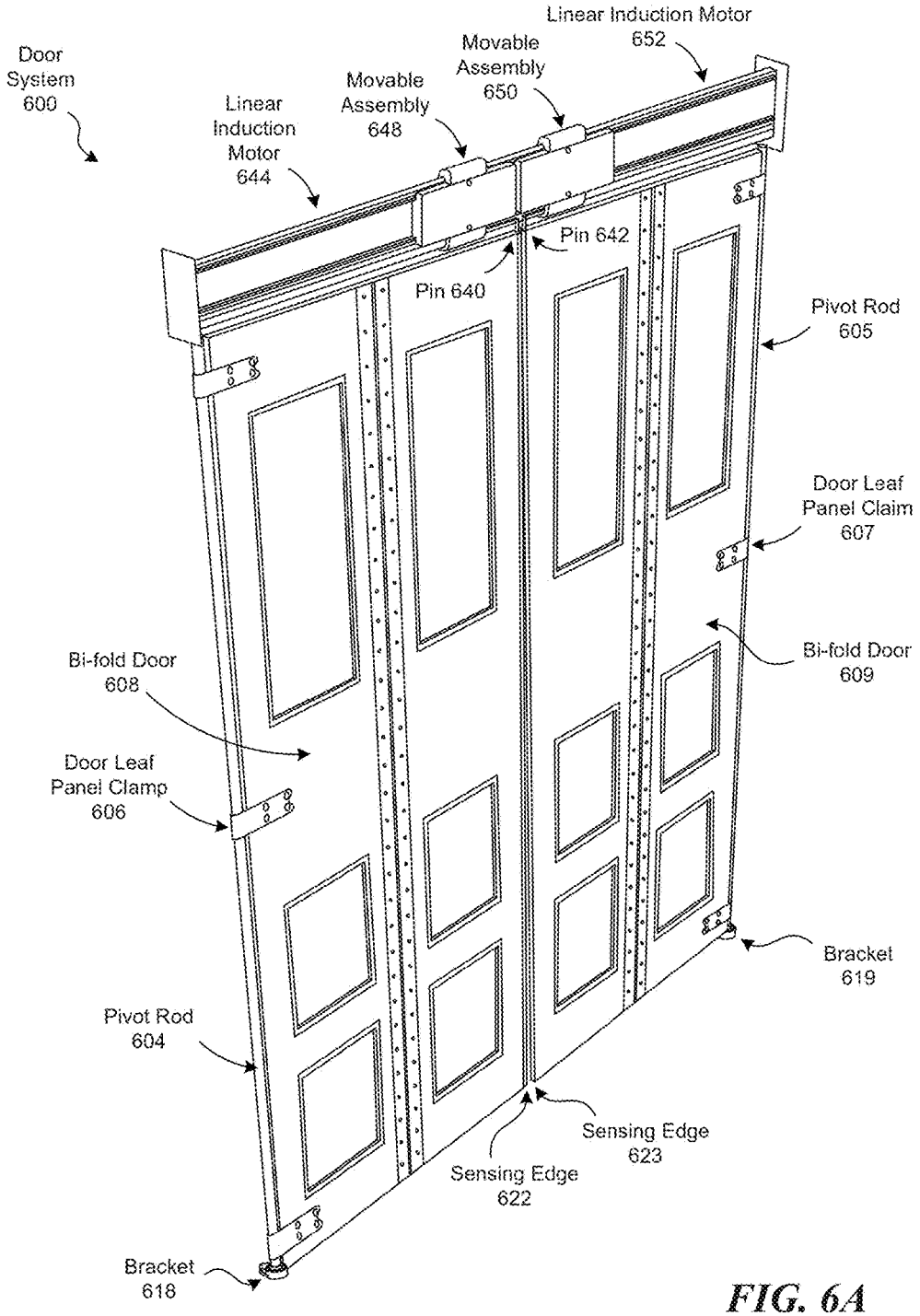
FIGS. 6A and 6B are illustrations of a door system that can be retrofitted in which a door is, respectively, closed and open, consistent with various embodiments.
Figure 6B:
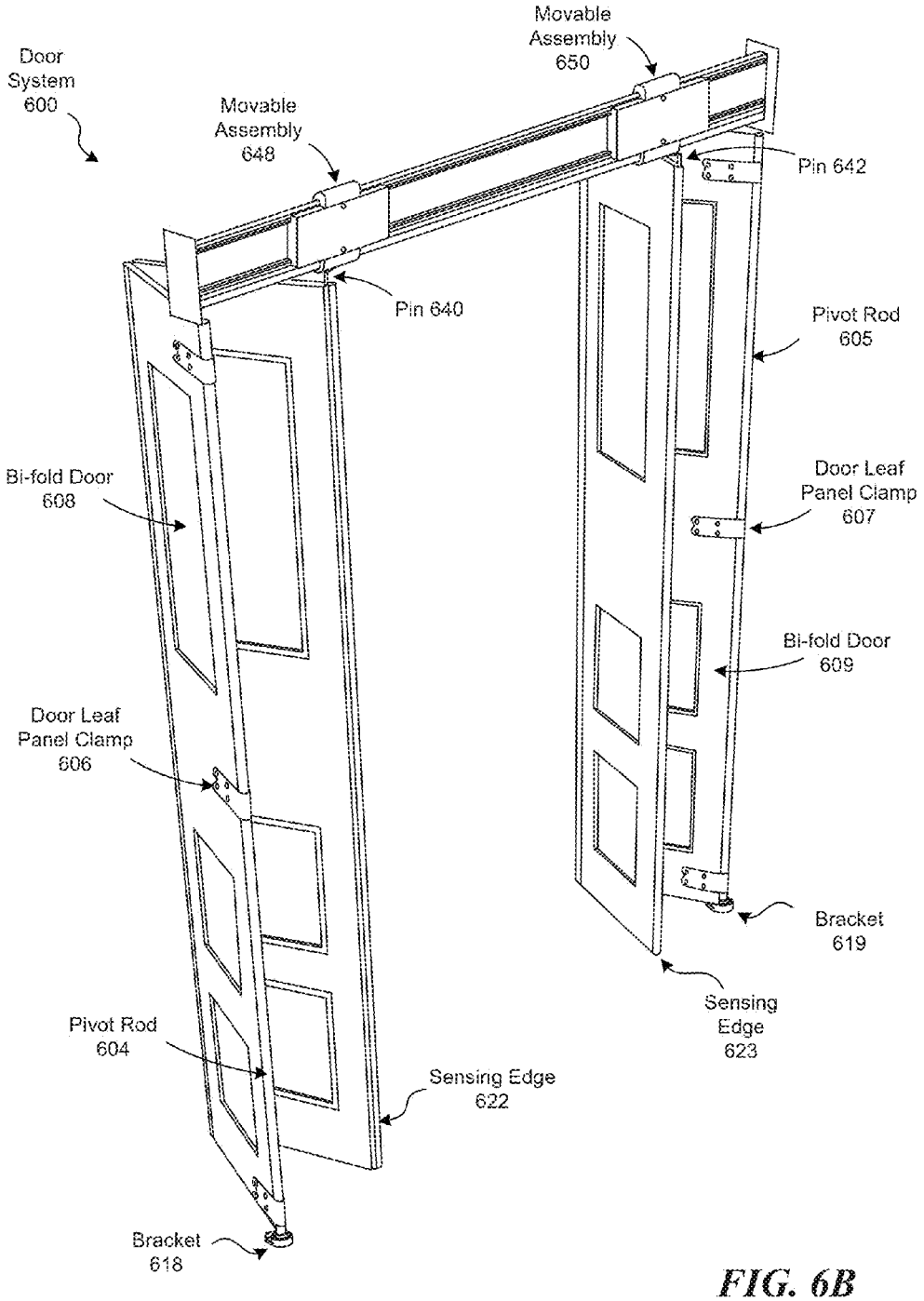

FIGS. 6A and 6B are illustrations of a door system that can be retrofitted in which a door is, respectively, closed and open, consistent with various embodiments. Door system 600 includes linear induction motor 644, which is a motor that moves movable assembly 648 linearly back and forth along a path that is parallel to the tops of bi-fold doors 608 and 609 when they are in a closed position, as is illustrated in FIG. 6A. Movable assembly 648 is coupled to pin 640, which is coupled to the top of a panel of bi-fold door 608 near the center edge of the panel (near sensing edge 622). Door system 600 further includes pivot rod 604, which is a hollow rod. Door leaf panel clamp 606 is attached to pivot rod 604 in a non-permanent manner, such as by a clamping force exerted by door leaf panel clamp 606 on pivot rod 604, by a screw or other fastener that couples door leaf panel clamp 606 to pivot rod 604, etc.

Door system 600 further includes linear induction motor 652, which moves movable assembly 650 back and forth similar to movable assembly 648. Movable assembly 650 is coupled to pin 642, which is coupled to the top of a panel of bi-fold door 609 near the center edge of the panel (near sensing edge 623). Door system 600 further includes pivot rod 605, which is a hollow rod. Door leaf panel clamp 607 is attached to pivot rod 605 in a non-permanent manner.

The inventor, though years of experience and significant investment of time and effort, has discovered many safety and reliability issues with door system 600. As a first example, the door leaf panel clamps of door system 600, such as door leaf panel clamps 606 and 607, can slip in service. Bi-fold doors of a passenger carrying rail vehicle, such as bi-fold doors 607 and 608, are exposed to significant vibration and to the elements (e.g., weather) during service. Further, the bi-fold doors can be subjected to extreme usage, such as by being opened and closed hundreds of times a day, seven days a week, 365 days a year, for years on end. Further, passengers often exert crush or other extreme loading against the doors, for example due to the vehicle being full, due to vandalism of passengers, etc. The combination of vibration and extreme usage can cause the door leaf panel clamps to slip.

In one example, the door leaf panel clamps are attached to a panel of a bi-fold door by a clamping force, such as a clamping force exerted by tightening a screw of the door leaf panel clamp that causes the clamp to exert pressure on a pivot rid, such as pivot rod 604. The inventor has discovered that, due to vibrations and extreme usage, the screw can loosen and the clamping pressure can be reduced, thereby causing the door leaf panel clamp to slip on the pivot rod. This slippage can be in a rotational direction, or in a vertical direction. The slippage can further cause the door leaf panel clamp to detach from the bi-fold door due to pressure exerted on the components that attach the door lead panel clamp to the panel of the bi-fold door. For example, when a door lead panel clamp is attached to a door panel of a bi-fold door with a screw, the slippage can cause the screw to come lose. The slippage can also lead to safety issues, such as making it easier for a passenger to push his way through a closed or supposedly closed bi-fold door, or being pushed through a closed or supposedly closed bi-fold door due to a crush of passengers exerting force against him.

In another example, the door leaf panel clamps are non-permanently attached to the pivot rod by screws or rivets that pass through both the clamp and the hollow pivot rod. The inventor has discovered that, once again due to vibrations and extreme usage, the screws or rivets can degrade the hole in the hollow pivot rod through which the screw or rivet passes. Further, the hole, being exposed to the elements, such as rain, heat, pollution, dirt, etc., can corrode or otherwise be further degraded by the elements. Due to the degradation of the hole, the door leaf panel clamp can once again slip, such as due the to screw or rivet being able to move around in the hole, or due to the screw or rivet falling out of the hole. Because the pivot rod is hollow, permanent methods of attaching the door leaf panel clamps to the pivot rod, such as by welding, may not be practical. For example, for welding, the thickness of the metal of the hollow pivot rod may be insufficient to enable reliable welding as a weld could burn through the material of the hollow pivot rod.

Further, welding eliminates the ability to adjust the angle of the panel of the bi-fold door relative to the pivot rod. When a door panel leaf clamp is non-permanently attached to a pivot rod, such as by a screw or a rivet, the screw or rivet can be removed, enabling the clamp to be rotated around the pivot rod to change the angle, and can then be re-attached by replacing the screw or rivet. Such angular adjustability can be necessary for the bi-fold doors to open and close properly when, for example, the rotation of the pivot rod is limited. Being able to adjust the angle of the door panel pivot clamp and the associated door panel may be necessary to achieve a desired, and safe, range of motion. When not properly adjusted, the bi-fold door may crush, e.g., the hand or other appendage of a passenger when the bi-fold door opens too close to an internal surface.

The inventor has discovered that a linear induction motor, such as linear induction motor 644, causes another set of reliability issues. For example, when opening a bi-fold door, such as bi-fold door 608, the linear induction motor needs to exert a large amount of force to open the door. A linear induction motor opens and closes a bi-fold door by moving a movable assembly, such as movable assembly 648, back and forth in a direction that is parallel to a closed bi-fold door. The movable assembly is able to move and open the bi-fold door because the movable assembly is coupled to the bi-fold door near the center edge of the door, such as by pin 640 which couples movable assembly 648 to bi-fold door 608.

However, exerting a force in a direction that is parallel to a closed bi-fold door is a non-optimal way to open a bi-fold door, as the force is not in a direction that tends to cause the bi-fold door to naturally open. As is illustrated in FIG. 6B, a bi-fold door opens in an accordion style by having the door panels rotate and accordion together such that they reduce the angle between the panels. A force exerted in a direction parallel to the bi-fold door when the door is closed does not tend to cause the panels to rotate. As a result, the motor may need to exert a significant amount of force before the panels of the bi-fold door begin to rotate and accordion together and the bi-fold door begins to open.

Once the bi-fold door begins to open, the force needed to keep the door opening at the same rate goes down significantly due to the panels no longer being parallel, but rather having started to accordion together as they open, reducing the angle between the panels. When the force of the motor cannot be quickly and accurately reduced to a well-controlled level to keep the bi-fold door opening at a controlled rate, the door can begin to accelerate and open erratically/wildly, once again causing a safety or reliability issue. A bi-fold door that opens too quickly can, e.g., hit a passenger with sufficient force to cause an injury. Opening a bi-fold door erratically/wildly is also hard on mechanical equipment of the door, e.g., due to heightened impact loading and stress, which can cause maintenance, reliability, and other issues.

Further, when the linear induction motor is not well-controlled, in addition to erratically opening and closing the bi-fold door, the motor can push the door too far, possibly creating a safety issue by, for example, crushing a passenger's hand or other appendage. When the motor does not open far enough, it can create a safety issue due to the door opening being insufficiently wide to let people safely pass in and out of the vehicle.

The inventor has discovered that another reliability issue is caused as a result of the bearings that are used in door system 600, such as bearings that are used at the top and bottom of pivot rod 604. A typical designer would not select a high-performance bearing for an application where the bearing rotates at a very low frequency, such as at the opening and closing frequency of a bi-fold door of a rail vehicle. Most designers select high-performance bearings for high-speed spinning mechanisms, such as for a cam shaft or wheel of a car. As a result, bearings used in door assembly 600 are not high-performance bearings. The inventor has discovered that bearings that are appropriate for typical low-speed spinning applications fail prematurely in door system 600, due to extreme conditions that include vibrations, exposure to the elements, exposure to extreme forces due to passengers pushing against the door, etc. In some cases these conditions cause the bearings become disfigured, such as by wear and tear resulting from these extreme conditions, with individual ball bearings in some instances becoming egg shaped.

The inventor has discovered that yet more reliability and safety issues are caused by a pivot rod, such as pivot rod 604, being hollow. Due to forces being applied to the bottom of the pivot rod, such as crush loading or other forces from passengers, the bottom of the pivot rod can become flared, like a trumpet bell. This deformation of the bottom of the pivot rod can cause cracking in the end of the pivot rod, which can lead to reliability issues or even catastrophic failure of the pivot rod, which is a safety issue.

Figure 7:
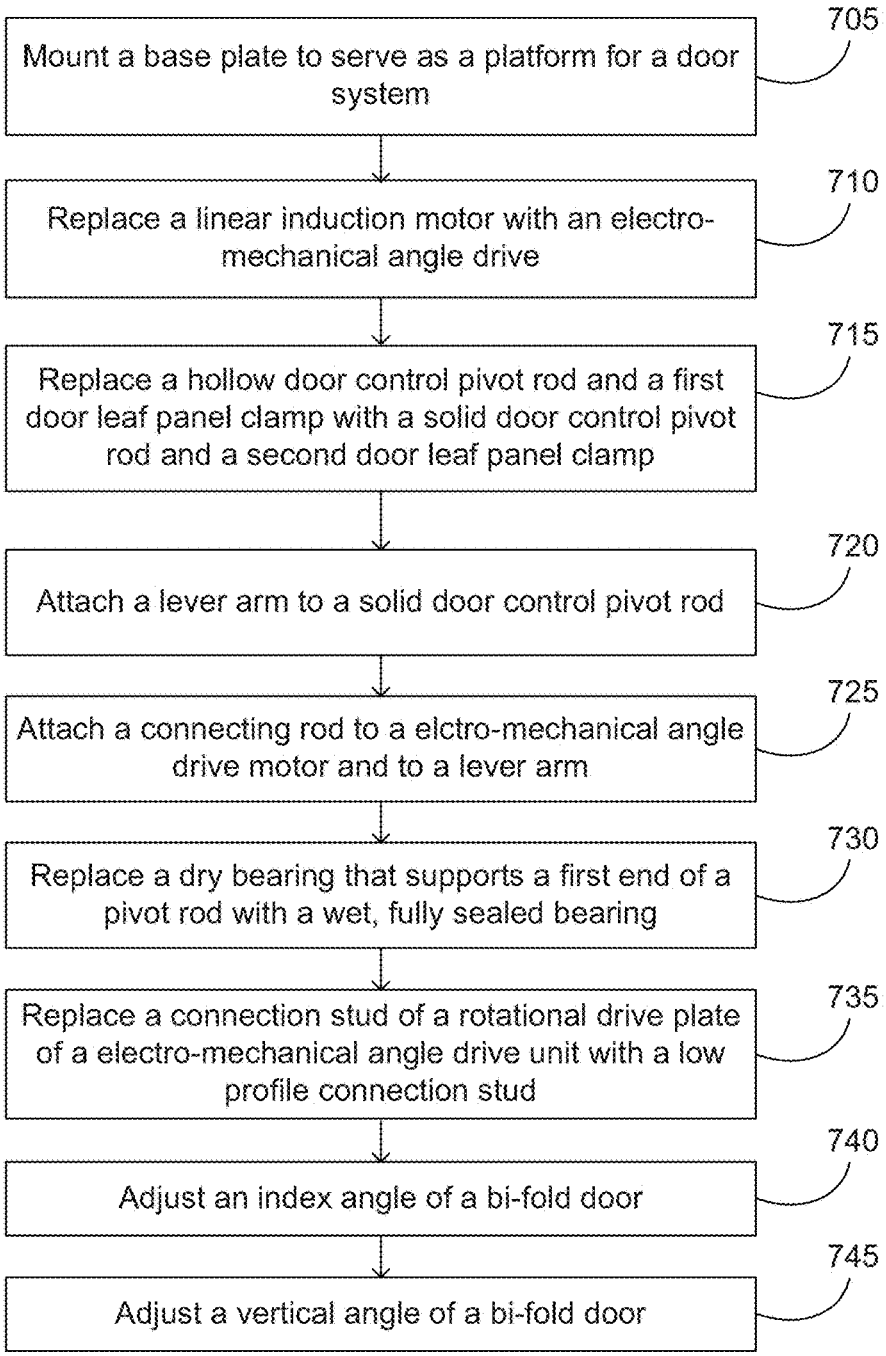
FIG. 7 is a flow diagram illustrating a method for retrofitting a door system of a President's Conference Committee (PCC) streetcar rail vehicle, consistent with various embodiments.

FIG. 7 is a flow diagram illustrating a method for retrofitting a door system of a PCC streetcar rail vehicle, consistent with various embodiments. While the method of FIG. 7 is applied to a PCC streetcar rail vehicle, the method can be applied to any of various passenger carrying rail vehicles, such as trains, streetcars, light rail vehicles, monorail vehicles, trams, trolleys, etc.

A door system, such as door system 600, can be retrofitted to result in an improved door system, such as door system 100. As discussed in the above description of FIGS. 6A and 6B, door system 600 has a number of attributes that cause reliability or safety issues. One such attribute is the linear induction motors of door system 600, which create issues due to opening bi-fold doors 608 and 609 with a linear motion. The inventor has determined that a significant improvement in reliability and performance of a door system can be achieved by opening bi-fold doors with a rotational motion rather than a linear motion. The inventor had discovered a method that involves a complex set of inter-related changes that, together, can achieve a significant improvement in reliability and performance for a bi-fold door system, such as door system 600.

To serve as a platform for a door system, a door system retrofit can include mounting a robust and continuous base plate, such as base plate 121, above bi-fold doors 608 and 609 (step 705). The base plate can be located at the base of a cabinet that is used to house door drive equipment, such as linear induction motors 644 and 652. The base plate can be made of steel, and can be between 0.25 and 0.5 inches thick. The inventor has determined though experience that metals thinner than about 0.25 inches tend to suffer from micro-cracking or fatigue cracking when used over extended periods of time in extreme environments, such as a street car door. The inventor has also determined that a base plate with a thickness above about 0.5 inches begins to become too heavy for use in a door system. A substantial base plate, such as a steel base plate between 0.25 and 0.5 inches, can facilitate a stable platform for the subsequent addition of subsystem components. For ease of future service and repairability, components can be fastened together with mechanical fasteners and aircraft style locking apparatus. To enhance serviceability, use of a thread locking compound can be avoided in the new door system.

In the example of FIG. 6A, linear induction motors 644 and 652 are mounted on a base platform of sheet metal. The inventor has discovered that the sheet metal of door system 600, as a result of use in an extreme environment, exhibits stress fractures, micro-cracking, or fatigue cracking. The sheet metal can be removed prior to mounting the base plate.

At step 710, one or more linear induction motors, such as linear induction motors 644 and 652, are removed and replaced with an electro-mechanical angle drive, such as electro-mechanical angle drive 120. An electro-mechanical angle drive is an electric motor with a drive shaft that is at an angle with reference to the center line of the stator/rotor assembly of the electro-mechanical angle drive. The angle of the drive shaft of electro-mechanical angle drive 120 is substantially equal to 90 degrees with reference to the center line of the stator/rotor assembly of electro-mechanical angle drive 120. The drive shaft of electro-mechanical angle drive 120 is connected to rotation control plate 112 and causes rotation control plate 112 to rotate. The center line of the stator/rotor assembly of electro-mechanical angle drive 120, after installation, runs in a direction that is substantially parallel to the tops of bi-fold doors 108 and 109 when the doors are closed.

The electro-mechanical angle drive can be mounted in a drive equipment cabinet, and can be mounted to a base plate. For example, electro-mechanical angle drive 120 can be mounted to base plate 121. The drive equipment cabinet can be thoroughly cleaned, evaluated, and repaired (as necessary). The structural features of the drive equipment cabinet can be closely evaluated to determine which repairs are needed. After the drive equipment cabinet is properly cleaned and repaired, a coat of paint can be applied to insure continued corrosion protection.

Replacing a linear induction motor with an electro-mechanical angle drive is advantageous for a number of reasons. As just one example, electro-mechanical angle drive 120 is advantageous because it has an inherent ability to smooth the opening of bi-fold doors. As discussed above in the description of FIGS. 6A and 6B, door system 600 has an issue in that it can open bi-fold doors 608 and 609 wildly or erratically. Referring to FIGS. 1A and 1B, to open bi-fold doors 108 and 109, electro-mechanical angle drive 120 turns rotation control plate 112 by approximately one quarter of a turn (starting from a "bottom" position, e.g., where an hour hand of a clock would be pointing when at a "6:00" position). As rotation control plate 112 turns, connection stud 111, which is connected to connecting rod 114, applies force to connecting rod 114. Connecting rod 114, in turn, applies force to adjustable lever arm 116, which applies torque to door control pivot rod 104 to rotate door control pivot rod 104, which causes bi-fold door 108 to open.

As rotation control plate 112 rotates, connection stud 111 initially moves primarily in the X direction towards adjustable lever arm 116. As rotation control plate 112 continues to rotate, connection stud 111 begins to move less in the X direction and more in the Y direction (due to the curved path that connection stud 111 takes as rotation control plate 112 rotates). This reduction in speed in the X direction inherently slows down the speed at which door control pivot rod 104 turns, even when the speed of rotation of rotation control plate 112 is constant. As rotation control plate 112 approaches one quarter of a turn, the motion of connection stud 111 in the X dimension is very slow. Resultantly, when electro-mechanical angle drive 120 opens the bi-fold doors, it opens them with a motion that reduces in speed the further that the bi-fold door opens, resulting in a safe and well-controlled bi-fold door opening motion.

At step 715, a hollow pivot rod and a door leaf panel clamp that is non-permanently connected to the hollow pivot rod are replaced with a solid pivot rod and a door leaf panel clamp that is permanently connected to the solid pivot rod. For example, hollow pivot rod 604 can be replaced by solid door control pivot rod 104, and door leaf panel clamp 606 can be replaced by door leaf panel clamp 106. Door control pivot rod 104 can be made of high grade steel.

Replacing a hollow pivot rod with a solid pivot rod has several advantages. For example, having a solid pivot rod enables the door leaf panel clamp to be securely and permanently attached to the pivot rod, such as by being welded to the pivot rod. Further, having a solid pivot rod can facilitate formation of a positive locking device to enable a positive locking connection with, e.g., adjustable lever arm 116. In the example of FIG. 1A, a positive locking device in the form of a spline can be formed at the top of door control pivot rod 104, as is illustrated by spline 302 of FIG. 3. When spline 302 is inserted in spline hole 205 of FIG. 2, a non-slip positive locking connection is formed between spline 302 and adjustable lever arm 116. The connection is such that when adjustable lever arm 116 is rotated around the center line of door control pivot rod 104, a torque is imparted on door control pivot rod 104 by adjustable lever arm 116. Further, because of the non-slip positive locking connection, adjustable lever arm 116 will not slip and will reliably apply the torque to door control pivot rod 104.

There are many ways that a door leaf panel clamp can be non-permanently attached to the hollow pivot rod. In one example, the door leaf panel clamp is a rectangular cross section flat bar bent in a 'U' shape that is clamped to the hollow pivot rod. The clamp force can be generated by tightening a screw that forces the two flat bars together, which causes the door leaf panel clamp to apply a clamping force to the hollow pivot rod. In another example, the door leaf panel clamp is attached to the hollow pivot rod by a removable screw, bolt, rivet, etc, that passes through the door leaf panel clamp and the hollow pivot rod.

There are also several ways that a door leaf panel clamp can be permanently attached to a solid pivot rod. In one example, the door leaf panel clamp is welded to the solid pivot rod. In another example, the door leaf panel clamp is formed as one piece with the solid pivot rod, such as by pouring metal in a form shaped to form both the pivot rod and a door leaf panel clamp as one piece of metal. In another example, the door leaf panel clamp is permanently attached to the solid pivot rod via brazing or soldering. In yet another example, the door leaf panel clamp is permanently attached to the solid pivot rod via a permanent adhesive.

At step 720 a lever arm is connected to the solid pivot rod. One or both of the lever arm or the solid pivot rod include a positive locking device. For example, in FIG. 1A, adjustable lever arm 116, which includes a positive locking device in the form of spline hole 205, is coupled to door control pivot rod 104 via a corresponding positive locking device of door control pivot rod in the form of spline 302. Spline 302 can be inserted in spline hole 205, and can be held in place with fastening hardware, such as a nylock nut. Spline hole 205 and spline 302 each enable adjustable lever arm 116 to form a positive locking connection with door control pivot rod 104 such that a force applied to adjustable lever arm 116 will be applied as torque to door control pivot rod 104 without adjustable lever arm 116 slipping relative to the direction of rotation of door control pivot rod 104. Adjustable level arm 116 does not slip when applying the torque because spline 302 is inserted in spline hole 205, which creates a non-slip positive locking connection between adjustable lever arm 116 and door control pivot rod 104.

At step 725, a connecting rod is attached to the electro-mechanical angle drive and to the lever arm. For example, in FIG. 1A, connecting rod 114 can be attached to electro-mechanical angle drive 120 by being attached to connection stud 111, which is attached to rotation control plate 112, which is attached to electro-mechanical angle drive 120. Connecting rod 114 can also be attached to adjustable lever arm 116.

The connecting rod can be attached in any of various ways. In some cases, the connecting rod is attached to one or both of the electro-mechanical angle drive and the level arm by use of a Heim connection, which is a connection that made by use of a Heim joint (also known as a rod end bearing). A Heim joint is a mechanical articulating joint that includes a ball swivel, with an opening through which a bolt or other attaching hardware may pass, that is pressed or otherwise encased in a circular casing with a threaded shaft attached. The threaded portion can be either male or female.

In a first example, a Heim joint is integrated at both a first end and a second end of connecting rod 114. To connect connecting rod 114 to electro-mechanical angle drive 120, the opening of the Heim joint on the first end of connecting rod 114 is placed over connection stud 111. To connect connecting rod 114 to adjustable lever arm 116, a piece of attaching hardware is integrated with adjustable lever arm 116, and the Heim join on the second end of connecting rod 114 is connected to the attaching hardware.

In a second example, instead of a Heim joint being integrated at the second end of connecting rod 114, a Heim joint is integrated with adjustable lever arm 116, and a piece of attaching hardware is integrated at the second end of connecting rod 114. To connect connecting rod 114 to adjustable lever arm 116, the Heim joint on the second end of connecting rod 114 is connected to the attaching hardware of adjustable lever arm 116.

At step 730, a dry bearing used to support the top or the bottom of a door control pivot rod can be replaced with a fully sealed, wet bearing, which can be a non-bushing type bearing. A non-bushing type bearing is a bearing that does not have a removable cylindrical lining for the central opening of the bearing. As discussed above, a typical designer would not select a high-performance bearing, such as a fully sealed wet bearing, for an application where the bearing rotates at a very low frequency, such as the opening and closing frequency of a bi-fold door of a rail vehicle. In the example of FIG. 6A, the designer chose a dry bearing, which is a lower performance bearing that is unlubricated, to support the top and bottom ends of pivot rod 604. However, the inventor has discovered that bearings that are appropriate for typical low-speed spinning applications fail prematurely in door system 600, due to extreme usage that includes vibrations, exposure to the elements, exposure to extreme forces due to passengers pushing against the door, etc.

Figure 5B:
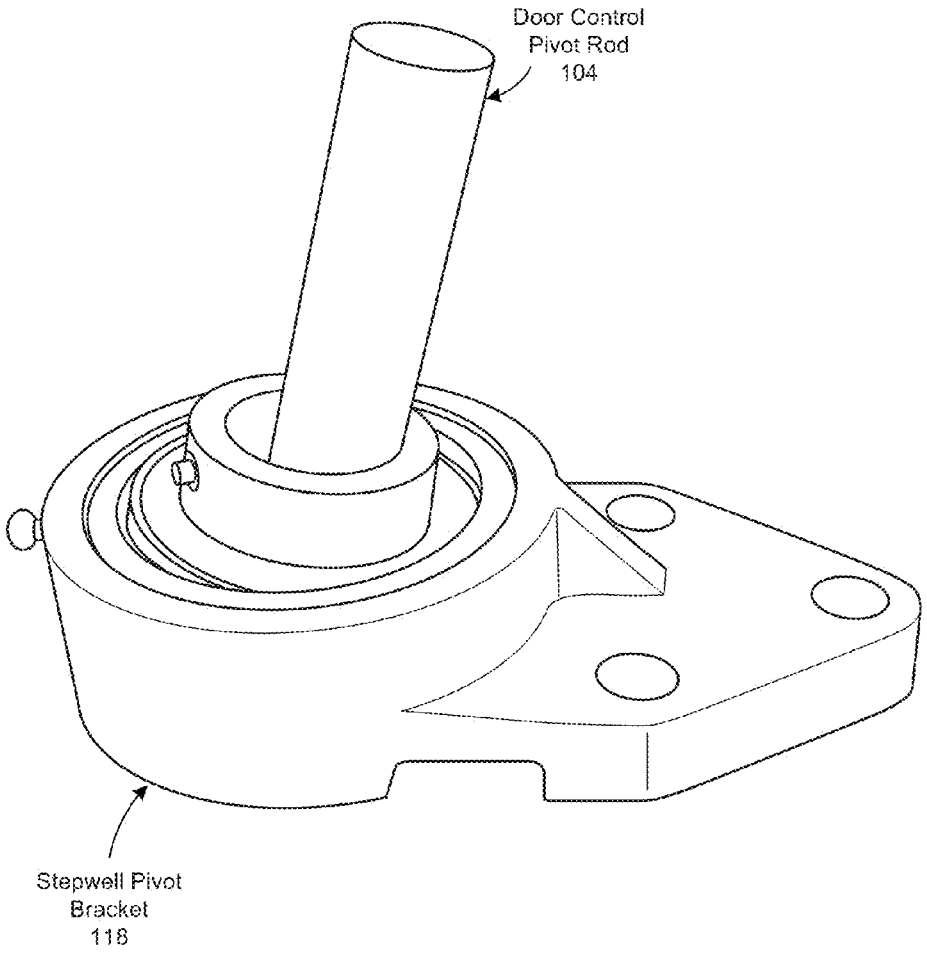
FIG. 5B is an illustration of a stepwell pivot bracket, consistent with various embodiments.

To enhance the durability and reduce the maintenance requirements of door system 600, the inventor has replaced a lower performance dry bearing at the top of pivot rod 604 with flange bearing 304 of FIG. 3, which is a higher performance fully sealed, wet bearing. A fully sealed, wet bearing is a bearing where lubricant is permanently sealed in the bearing. Flange bearing 304 can include a high quality sealed double row ball bearing which is mounted in a removable three-bolt flange. The inventor has also replaced a lower performance dry bearing that is part of bracket 618 with a higher performance fully sealed, wet bearing that is part of stepwell bracket 118, which is illustrated at FIG. 5B.

At step 735, a connection stud of a rotational drive plate of an electro-mechanical angle drive is replaced with a low profile connection stud. In an example, electro-mechanical angle drive 120 comes with connection studs that are not compatible with a door system. The original connection studs can be removed, and can be replaced with low profile connection studs 110 and 111. For example, the original connection studs may not achieve a desired clearance with other components of the door system, and the use of low-profile connection studs may enable the desired clearance to be achieved.

At step 740, an index angle of a bi-fold door is adjusted. An index angle is the angle of a bi-fold door when the door system is in a selected state or position. For example, the door system can be in a state where the bi-fold door is in a fully closed position, can be in a state where the bi-fold door is in a fully open position, etc. For door system 600, the index was adjusted by, e.g., loosening the clamping force of door leaf panel clamp 606 on pivot rod 604. Once door leaf panel clamp 606 (and the other door leaf panel clamps connected to pivot rod 604) was loosened, the index angle of bi-fold door 608 could be adjusted. Once adjusted to the desired index angle, door leaf panel clamp 606 could be tightened.

Enabling accurate and reliable adjustment of the index angle of a the new door system is a significant challenge. This is because the new door leaf panel clamps are permanently attached to the solid door control pivot rod, so adjusting an index angle of a bi-fold door of a post-retrofit door system cannot be achieved in the manner described above.

The problem of enabling the index angle of a bi-fold door to be accurately and reliably adjusted, which is required for proper functioning of a door system, was a difficult problem for the inventor to solve. His solution has two components, a gross adjustment capability and a fine adjustment capability. The gross adjustment capability involves properly orienting adjustable lever arm 116 on spline 302. The index angle of bi-gold door 108 can be changed in discrete amounts by removing adjustable lever arm 116 from spline 302, rotating adjustable lever arm 116 by one spline tooth, and replacing adjustable lever arm 116 on spline 302. Fine grain adjustment of the index angle is achieved via adjustable lever arm 116. Index adjustment 210 of FIG. 2 can be used to achieve fine grain adjustment of the index angle by rotating index adjustment 210 until the desired index angle is achieved.

At step 745, a vertical angle of a bi-fold door is adjusted. In order to close and open properly, and to achieve a desired protection from the elements, the vertical angle of bi-fold door 108 needs to be properly adjusted. To facilitate adequate vertical adjustment, stepwell pivot bracket 118 and flange bearing 304 were selected to enable the angle of door control pivot rod 104 to vary. FIG. 5B illustrates the ability of stepwell pivot bracket 118 to enable door control pivot rod 104 to pivot, changing the vertical angle of door control pivot rod 104. Flange bearing 304 has a similar ability to pivot. To change the angle of bi-fold door 108, the location of flange bearing 304 of FIG. 3 can be changed with reference to base plate 121. The three-bolt flange's connection to base plate 121 can be loosened by loosening the three bolts of the flange. The three bolt flange can be repositioned to achieve the desired vertical angle for bi-fold door 108, and the three bolts can be re-tightened.

FIG. 8 is a high-level block diagram showing an example of a processing device 800. Processing device 800 may include two or more processing devices, which may be coupled to each other via a network or multiple networks. A network can be referred to as a communication network.

In the illustrated embodiment, the processing system 800 includes one or more processors 810, memory 811, a communication device 812, and one or more input/output (I/O) devices 813, all coupled to each other through an interconnect 814. The interconnect 814 may be or include one or more conductive traces, buses, point-to-point connections, controllers, adapters and/or other conventional connection devices. Each processor 810 may be or include, for example, one or more general-purpose programmable microprocessors or microprocessor cores, microcontrollers, application specific integrated circuits (ASICs), programmable gate arrays, or the like, or a combination of such devices. The processor(s) 810 control the overall operation of the processing device 800. Memory 811 may be or include one or more physical storage devices, which may be in the form of random access memory (RAM), read-only memory (ROM) (which may be erasable and programmable), flash memory, miniature hard disk drive, or other suitable type of storage device, or a combination of such devices. Memory 811 may store data and instructions that configure the processor(s) 810 to execute operations in accordance with the techniques described above. The communication device 812 may be or include, for example, an Ethernet adapter, cable modem, Wi-Fi adapter, cellular transceiver, Bluetooth transceiver, or the like, or a combination thereof. Depending on the specific nature and purpose of the processing device 800, the I/O devices 813 can include devices such as a display (which may be a touch screen display), audio speaker, keyboard, mouse or other pointing device, microphone, camera, etc.

Unless contrary to physical possibility, it is envisioned that (i) the methods/steps described above may be performed in any sequence and/or in any combination, and that (ii) the components of respective embodiments may be combined in any manner.

Some techniques introduced above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), etc.

Software or firmware to implement some of the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible medium includes recordable/non-recordable media (e.g., read-only memory (ROM); random access memory (RAM); magnetic disk storage media; optical storage media; flash memory devices; etc.), etc.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

The invention claimed is:

1. A door system of a President's Conference Committee (PCC) streetcar rail vehicle that comprises:

an electro-mechanical angle drive motor that generates rotational motion;

a solid door control pivot rod that includes a first positive locking device;

a door leaf panel clamp that is permanently connected to the solid door control pivot rod, wherein the door leaf panel clamp is adapted to mechanically support a door panel of the door system and to impart rotational force to the door panel;

a lever arm that includes a second positive locking device and that is coupled to the solid door control pivot rod by a non-slip connection that is formed when the second positive locking device interlocks with the first positive locking device; and a connecting rod that is coupled to the electro-mechanical angle drive motor and to the lever arm to enable the connecting rod to impart motion generated by the electro-mechanical angle drive motor to the lever arm, wherein the lever arm is adapted to convert the imparted motion to torque imparted to the solid door control pivot rod, wherein the door leaf panel clamp that is permanently connected to the solid door control pivot rod is permanently connected to the solid door control pivot rod via a weld, wherein the second positive locking device of the lever arm is a metal structure that is formed or shaped to interlock with the first positive locking device of the solid door control pivot rod, wherein the first positive locking device of the solid door control pivot rod is a spline that is part of the solid door control pivot rod, and wherein, when the metal structure rotates, the metal structure applies the torque to the spline to cause the solid door control pivot rod to rotate.

2. A door system of a President's Conference Committee (PCC) streetcar rail vehicle that comprises:

an electro-mechanical angle drive motor that generates rotational motion;

a solid door control pivot rod that includes a first positive locking device;

a door leaf panel clamp that is permanently connected to the solid door control pivot rod, wherein the door leaf panel clamp is adapted to mechanically support a door panel of the door system and to impart rotational force to the door panel;

a lever arm that includes a second positive locking device and that is coupled to the solid door control pivot rod by a non-slip connection that is formed when the second positive locking device interlocks with the first positive locking device;

a connecting rod that is coupled to the electro-mechanical angle drive motor and to the lever arm to enable the connecting rod to impart motion generated by the electro-mechanical angle drive motor to the lever arm, wherein the lever arm is adapted to convert the imparted motion to torque imparted to the solid door control pivot rod;

a first sealed, non-bushing type bearing that is coupled to one end of the solid door control pivot rod;

a second sealed, non-bushing type bearing that is coupled to a second end of the solid door control pivot rod;

a first Heim connection that is coupled to a first end of the connecting rod; and a second Heim connection that is coupled to a second end of the connecting rod.

* * * * *